US007500359B2

(12) United States Patent
Evans-Beauchamp

(10) Patent No.: US 7,500,359 B2
(45) Date of Patent: Mar. 10, 2009

(54) REVERSE FLOW HEAT EXCHANGER FOR EXHAUST SYSTEMS

(75) Inventor: Lincoln Evans-Beauchamp, Palo Alto, CA (US)

(73) Assignee: Purify Solutions, Inc., Palo Alto, CA (US)

( * ) Notice: Subject to any disclaimer, the term of this patent is extended or adjusted under 35 U.S.C. 154(b) by 2 days.

(21) Appl. No.: 11/412,481

(22) Filed: Apr. 26, 2006

(65) Prior Publication Data

US 2007/0251222 A1 Nov. 1, 2007

(51) Int. Cl.
*F01N 3/00* (2006.01)

(52) U.S. Cl. ..... 60/298; 60/299; 60/320; 60/321; 60/323; 165/97; 165/DIG. 100

(58) Field of Classification Search ..... 60/274, 60/298, 299, 320, 321, 323, 324; 165/97, 165/DIG. 100
See application file for complete search history.

(56) References Cited

U.S. PATENT DOCUMENTS 2,418,191 A * 4/1947 Parrish ..... 165/156
3,086,353 A 4/1963 Ridgway
3,148,442 A * 9/1964 Gier, Jr. ..... 29/890.054
3,165,152 A * 1/1965 Jones ..... 165/166
3,775,971 A 12/1973 Gadefelt
3,912,464 A 10/1975 Schulz
4,000,885 A 1/1977 VanDril
4,144,020 A 3/1979 LaHaye et al.
4,299,561 A 11/1981 Stokes
4,312,321 A * 1/1982 Skow ..... 126/99 A
4,322,387 A 3/1982 Virk et al.
4,338,998 A * 7/1982 Goloff ..... 165/165
4,524,587 A 6/1985 Kantor
4,851,015 A 7/1989 Wagner et al.
4,867,768 A 9/1989 Wagner et al.
4,976,310 A * 12/1990 Jabs ..... 165/82
5,143,700 A 9/1992 Anguil (Continued)

FOREIGN PATENT DOCUMENTS

JP 2000282841 10/2000

(Continued)

OTHER PUBLICATIONS

U.S. Appl. No. 11/404,424, Lincoln Evans-Beauchamp, Particle Burning in an Exhaust System, filed Apr. 14, 2006.

(Continued)

*Primary Examiner*—Binh Q Tran
(74) *Attorney, Agent, or Firm*—Carr & Ferrell LLP

(57) ABSTRACT

An exhaust system includes a reverse flow heat exchanger having a plate separating an intake chamber and an exit chamber, each chamber having an inlet and an outlet located at opposing ends to allow flow therethrough. The plate can include a vane connected to the end of the plate in the vicinity of an inlet or an outlet. The vane is configured to reduce resistance to fluid flow near the intake chamber inlet. The exhaust system includes a heating manifold, such as a combustion chamber, configured to receive an exhaust stream from the intake chamber, further heat the exhaust stream, and return the exhaust stream to the exit chamber. Embodiments of the system can be configured to additionally perform as a catalytic converter and/or a muffler.

27 Claims, 9 Drawing Sheets

U.S. PATENT DOCUMENTS

| | | | | |
|---|---|---|---|---|
| 5,179,259 | A | 1/1993 | Martin | |
| 5,183,646 | A | 2/1993 | Anderson et al. | |
| 5,335,492 | A * | 8/1994 | Zirkel | 60/298 |
| 5,450,721 | A | 9/1995 | Golben et al. | |
| 5,458,673 | A | 10/1995 | Kojima et al. | |
| 5,571,298 | A | 11/1996 | Buck | |
| 5,855,636 | A | 1/1999 | Alexander | |
| 5,987,885 | A * | 11/1999 | Kizer et al. | 60/298 |
| 6,090,187 | A | 7/2000 | Kumagai | |
| 6,119,457 | A * | 9/2000 | Kawamura | 60/618 |
| 6,238,815 | B1 | 5/2001 | Skala et al. | |
| 6,302,935 | B1 | 10/2001 | Kudoh | |
| 6,360,532 | B2 * | 3/2002 | Strahle et al. | 60/321 |
| 6,390,185 | B1 * | 5/2002 | Proeschel | 165/155 |
| 6,422,007 | B1 | 7/2002 | Hartick | |
| 6,488,079 | B2 | 12/2002 | Zifferer | |
| 6,708,485 | B2 * | 3/2004 | Hinder et al. | 60/288 |
| 6,770,116 | B2 | 8/2004 | Kojima | |
| 6,855,250 | B2 | 2/2005 | Nixdorf | |
| 6,865,883 | B2 | 3/2005 | Gomulka | |
| 6,983,105 | B1 | 1/2006 | Greene | |
| 7,266,943 | B2 | 9/2007 | Kammel | |
| 2002/0092422 | A1 | 7/2002 | Ament et al. | |
| 2003/0019354 | A1 | 1/2003 | Kojima | |
| 2003/0230059 | A1 | 12/2003 | Nixdorf | |
| 2004/0065013 | A1 | 4/2004 | DeVries | |
| 2004/0118111 | A1 | 6/2004 | Covit | |
| 2005/0252202 | A1 | 11/2005 | Page et al. | |
| 2006/0260297 | A1 | 11/2006 | Koch | |

FOREIGN PATENT DOCUMENTS

| | | |
|---|---|---|
| JP | 2003193832 | 7/2003 |
| JP | 2005-299474 | 10/2005 |
| WO | WO9915466 | 4/1999 |

OTHER PUBLICATIONS

U.S. Appl. No. 11/412,289, Lincoln Evans-Beauchamp, Air Purification System Employing Particle Burning, filed Apr. 26, 2006.
U.S. Appl. No. 11/412,289, Evans-Beauchamp, Air Purification System Employing Particle Burning, filed Apr. 26, 2006.
U.S. Appl. No. 11/404,424, Evans-Beauchamp, Particle Burning in an Exhaust System, filed Apr. 14, 2006.
U.S. Appl. No. 11/787,851, Evans-Beauchamp, Particle Burner Including a Catalyst Booster for Exhaust System, filed Apr. 17, 2007.
U.S. Appl. No. 11/800,110, Evans-Beauchamp, Particle Burner Disposed Between an Engine and a Turbo Charger, filed May 3, 2007.

* cited by examiner

REVERSE FLOW HEAT EXCHANGER FOR EXHAUST SYSTEMS

CROSS-REFERENCE TO RELATED APPLICATIONS

This application is related to U.S. Non-Provisional patent application Ser. No. 11/404,424 filed Apr. 14, 2006 and entitled "Particle Burning in an Exhaust System." This application is also related to U.S. Non-Provisional patent application Ser. No. 11/412,289 filed Apr. 26, 2006 and entitled "Air Purification System Employing Particle Burning."

BACKGROUND OF THE INVENTION

1. Field of the Invention

The present invention relates generally to emission controls and more particularly to systems for reducing particles in exhaust streams.

2. Description of the Prior Art

When a fuel burns incompletely, pollutants such as particles and hydrocarbons are released into the atmosphere. The United States Environmental Protection Agency has passed regulations that limit the amount of pollutants that, for example, diesel trucks, power plants, engines, automobiles, and off-road vehicles can release into the atmosphere.

Currently, industries attempt to follow these regulations by adding scrubbers, catalytic converters and particle traps to their exhaust systems. However, these solutions increase the amount of back pressure exerted on the engine or combustion system, decreasing performance. In addition, the scrubbers and particle traps themselves become clogged and require periodic cleaning to minimize back pressure.

Radiation sources and heaters have been used in exhaust systems, for example, to periodically clean the particle traps or filter beds. Others solutions have included injecting fuel into the filter beds or exhaust streams as the exhaust enters the filter beds to combust the particles therein. However, the filter beds can be sensitive to high temperatures and the radiation sources and heaters must be turned off periodically.

SUMMARY

An exhaust system comprises a reverse flow heat exchanger including a plate defining a plane and separating an exit chamber and an intake chamber. Each chamber of the heat exchanger has an inlet and an outlet located at opposing ends to allow flow therethrough. The exhaust system also comprises a first manifold coupled to the reverse flow heat exchanger and in fluid communication with the intake chamber inlet. A vane disposed within the first manifold is situated relative to the intake chamber inlet so as to reduce resistance to fluid flow near the intake chamber inlet. The exhaust system can also comprise a heating manifold that receives exhaust from the intake chamber, heats the exhaust, and returns the exhaust to the exit chamber. In some embodiments, the heating manifold is a combustion chamber for burning particles in the exhaust. In these embodiments the exhaust system can also comprise a radiation source for heating the particles to at least an ignition temperature.

Another exemplary exhaust system comprises a first manifold and a reverse flow heat exchanger coupled to the first manifold. Here, the reverse flow heat exchanger defines a transverse plane and includes a plurality of parallel plates separating a number of chambers, each chamber having an inlet and an outlet. These chambers comprise a set of intake chambers alternating with a set of exit chambers, where the inlets of the intake chambers being in fluid communication with the first manifold and the outlets of the intake chambers being in fluid communication with the inlets of the exit chambers. The exhaust system can further comprise a heating manifold coupled to the reverse flow heat exchanger to provide the fluid communication between the outlets of the intake chambers and the inlets of the exit chambers.

A vehicle comprising an internal combustion engine and the exhaust system described above is also provided. The exhaust system can serve as either or both of a muffler and a catalytic converter.

DETAILED DESCRIPTION

An exhaust system comprises a reverse flow heat exchanger coupled to a means for heating the exhaust gas, such as a combustion chamber for burning particles carried by the exhaust gas. The reverse flow heat exchanger recovers heat from the exhaust gas after passing through the heating means and transfers the heat to the exhaust gas entering the heating means. The heat recovery increases the energy efficiency of the exhaust system and provides further advantages as described below.

Figure 1:
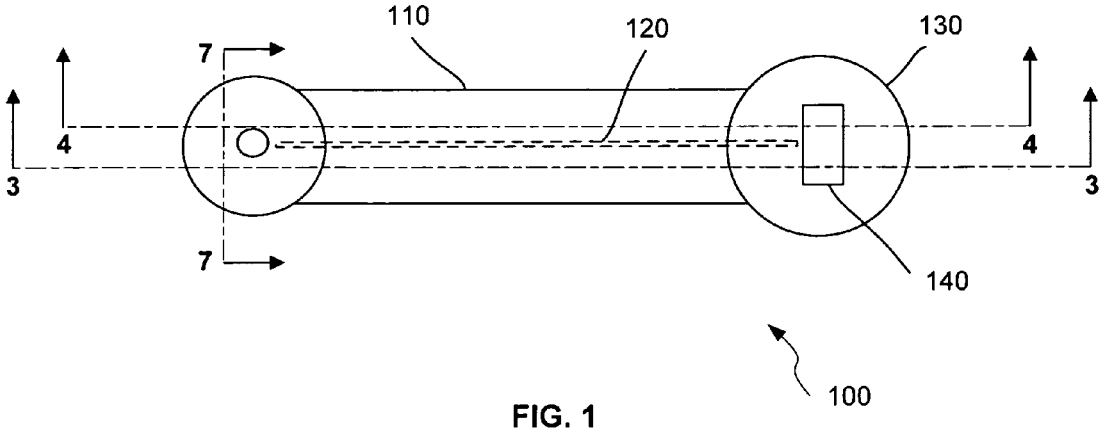
FIGS. 1 and 2 depict top and front views, respectively, of an exemplary system for burning particles in an exhaust system in accordance with an embodiment of the invention.
Figure 2:
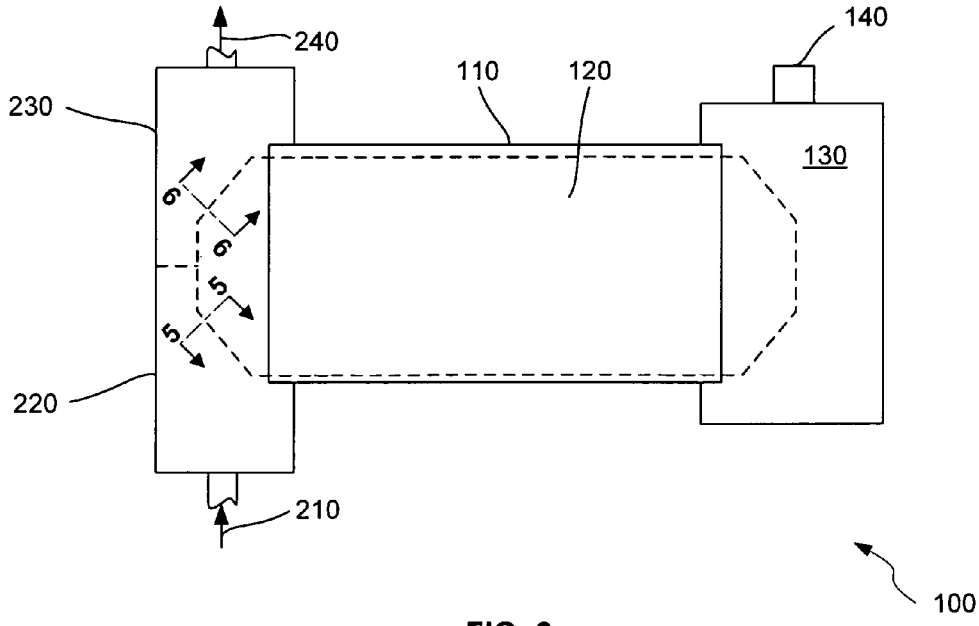

FIGS. 1 and 2 show top and front views, respectively, of an exemplary exhaust system 100. The exhaust system 100 is generally applicable and can be included, for example, as part of a vehicle, a power plant, or a fireplace. The embodiment depicted in FIGS. 1 and 2 comprises a reverse flow heat exchanger 110 including two chambers separated by a plate 120 (shown in dashed lines to indicate that the plate is internal to the heat exchanger 110). One chamber of the heat exchanger 110 is in fluid communication between a first manifold 220 and a combustion chamber 130. A second chamber of the heat exchanger 110 is in fluid communication between the combustion chamber 130 and a second manifold 230. The chambers within the heat exchanger 110 are described in greater detail below. The heat exchanger 110 including the plate 120, the combustion chamber 130, and the manifolds 220, 230 can be constructed using any suitable material capable of withstanding the exhaust gases at the operating temperature of the exhaust system 100. Suitable materials include stainless steel, titanium, and ceramics. The plate 120 should be constructed of a material with high thermal conductivity, such as a metal, to provide good heat transfer between the chambers.

In operation, exhaust gas 210 from a source such as a diesel engine enter the manifold 220 and are directed through the heat exchanger 110 to the combustion chamber 130. In the illustrated embodiment, particles within the exhaust are burned in the combustion chamber 130, significantly increasing the temperature of the exhaust gas. Combustion of the particles is facilitated by a radiation source 140 attached to the combustion chamber 130. Suitable radiation sources 140 and designs for the combustion chamber 130 are described in U.S. patent application Ser. No. 11/404,424 filed on Apr. 14, 2006 and titled "Particle Burning in an Exhaust System."

The heated exhaust gas 240 exits the combustion chamber 130, passes back through the heat exchanger 110, and leaves the exhaust system 100 through the manifold 230. In the heat exchanger 110, heat from the hot gas 240 exiting the combustion chamber 130 is transferred to the incoming exhaust gas 210 from the manifold 220 through the plate 120. By using the residual heat of the combustion of the particles to heat the incoming exhaust gas 210, the exhaust system 100 utilizes less energy. Other advantages of the heat exchanger 110 are discussed herein.

It will be appreciated that although the illustrated embodiment in FIGS. 1 and 2 includes a combustion chamber 130, the present invention is not limited to exhaust systems including combustion chambers. While the heat exchanger 110 needs to be coupled to some heating source to raise the temperature of the exhaust gas, the combustion chamber 130 is merely one example. The combustion chamber 130 can be replaced, for example, with a catalytic converter comprising a catalytic material supported on a substrate that is heated by a resistive heating element. In general terms, the combustion chamber 130 is an example of a heating manifold that heats the exhaust gas from the intake chamber 310 of the heat exchanger 110 and returns it to the exit chamber 410 of the heat exchanger 110.

Figure 3:
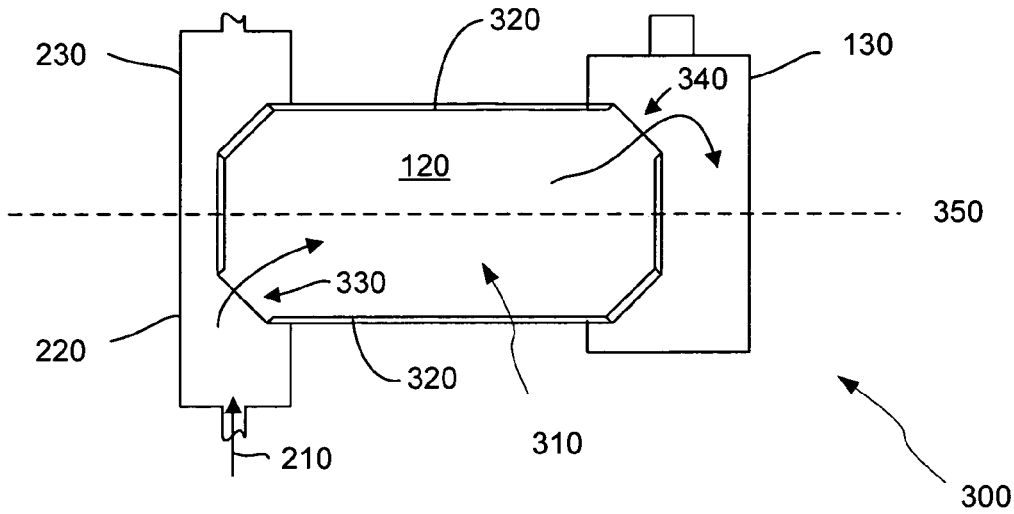
FIGS. 3 and 4 depict cross sections of the intake chamber and exit chamber, respectively, of the system shown in FIGS. 1 and 2.
Figure 4:
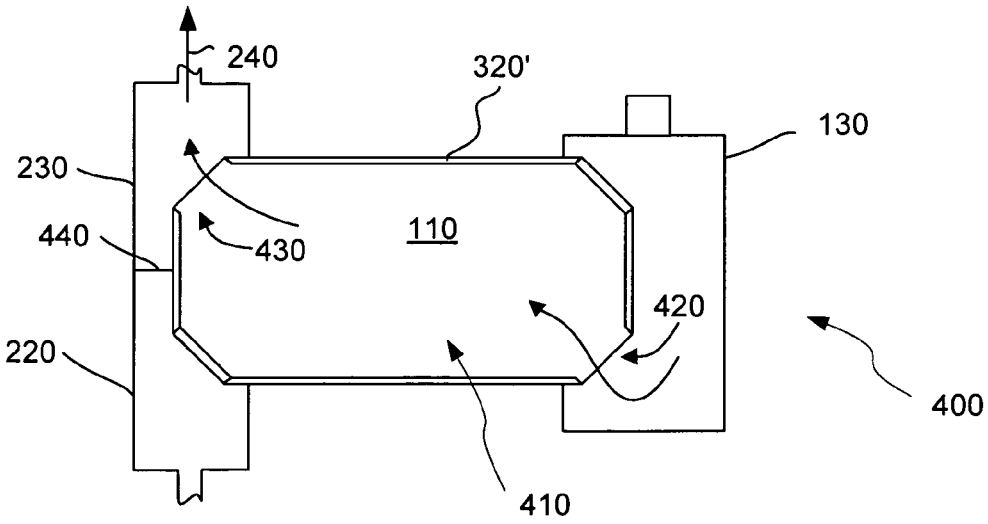

FIG. 3 and FIG. 4 are cross sections of the exhaust system 100. In FIG. 3, a cross section 300 is taken along section 3-3 in FIG. 1 through an intake chamber 310. The intake chamber 310 is formed between the plate 120, an exterior wall of the heat exchanger 110 (not visible in this perspective), and two spacers 320 that maintain a proper spacing between the exterior wall and the plate 120. Openings between the spacers 320 form an inlet 330 and an outlet 340 of the intake chamber 310. The inlet 330 and the outlet 340 provide fluid communication between the intake chamber 310 and the manifold 220 and the combustion chamber 130, respectively.

The cross section 300 is characterized by a transverse plane 350, seen edge on in FIG. 3, which bisects the heat exchanger 110 along a longitudinal axis thereof. In this embodiment, the inlet 330 is below the transverse plane 350 and the outlet 340 is above the transverse plane 350. Placing the inlet 330 and outlet 340 on opposite sides of the transverse plane 350 causes the exhaust gas to traverse a diagonal of the intake chamber 310.

In FIG. 4, a cross section 400 is taken along section 4-4 in FIG. 1 through an exit chamber 410. The exit chamber 410 is formed between the plate 120 (not visible in this perspective), another exterior wall of the heat exchanger 110, and two spacers 320'. As above, openings between the spacers 320' form an inlet 420 and an outlet 430 that provide fluid communication with the combustion chamber 130 and the manifold 230, respectively. In various embodiments, manifolds 220 and 230 consist of a continuous tube separated by a baffle 440, generally aligned with the transverse plane 350, configured to prevent fluid communication between manifolds 220 and 230. In these embodiments, the manifolds 220 and 230 share a common longitudinal axis that is approximately parallel to a plane defined by the plate 120 and perpendicular to the transverse plane 350.

In the illustrated embodiment, the inlet 420 is below the transverse plane 350 and the outlet 430 is above the transverse plane 350. As with the intake chamber 310, the inlet 420 and outlet 430 are on opposite sides of the transverse plane 350 so that the fluid flow is diagonal across the exit chamber 410. Arranging the fluid flows along the diagonals of the two chambers 310, 410 provides the gases 210 and 240 greater opportunity to transfer heat therebetween.

Figure 5:
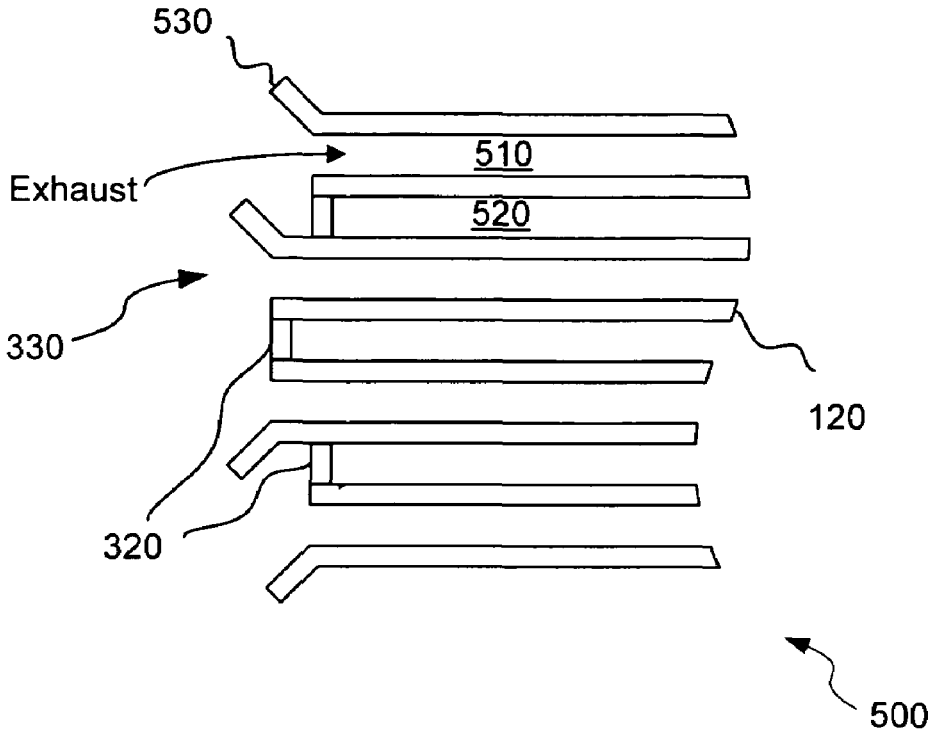
FIG. 5 depicts a cross section taken along the line 5-5 of FIG. 2.

Some embodiments of the heat exchanger 110 include multiple plates 120 to form multiple alternating intake and exit chambers 310, 410 to provide even greater heat transfer. FIGS. 1 and 2 are also representative of these embodiments. FIG. 5 shows a cross section 500 taken along the section 5-5 in FIG. 2 of an exhaust system 100 including multiple plates 120. Cross section 500 shows the multiple plates 120 forming alternating intake chambers 510 and exit chambers 520 where the intake chambers 510 are open to receive exhaust from the manifold 220. Similar to the above chambers 310, 410, each of the chambers 510, 520 are formed by two plates 120 separated by spacers 320 with openings therebetween to provide inlets and outlets. It will be appreciated that in these embodiments, as well as in the embodiments with only a single set of chambers 310, 410, the external walls of the heat exchanger 110 can also be plates 120. One method of forming the heat exchanger 110 is to assemble a stack of alternating plates 120 and spacers 320 and to weld or bolt the assembly together.

The manifold 220 can also include one or more vanes disposed relative to an intake chamber inlet 330 to reduce resistance to fluid flow near that intake chamber inlet 330. For example, vanes 530 extend from the plates 120 in FIG. 5. The vanes 530 effectively increase the orifice size of the inlets 330 to reduce fluid frictions. In various embodiments, vanes 530 can be joined to the ends of the plates 120. In other embodiments, the vanes 530 are integral with the plates 120 and can be formed by bending the ends of the plates 120 before assembling the heat exchanger 110.

Figure 6:
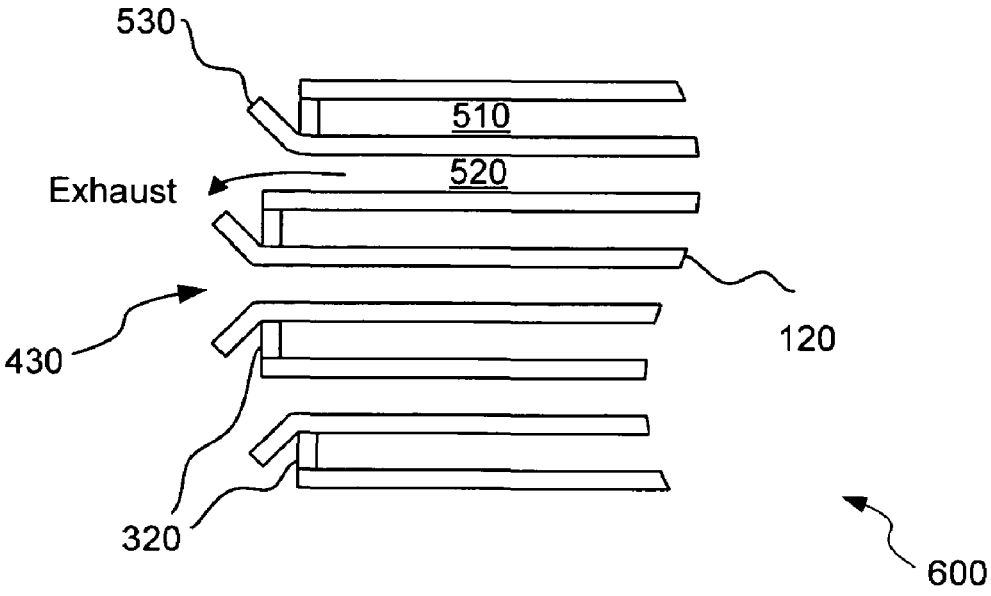
FIG. 6 depicts a cross section taken along the line 6-6 of FIG. 2.

FIG. 6 shows a cross section 600 taken along section 6-6 in FIG. 2 of the exhaust system 100. Cross section 600 shows multiple plates 120 forming alternating intake chambers 510 and exit chambers 520 where the exit chambers 520 are open to vent exhaust to the manifold 220. The manifold 230 can also include one or more vanes 530 disposed relative to the exit chamber outlets 430 in order to reduce resistance to fluid flow near the exit chamber outlets 430. For example, a vane 530 extends from the plate 120 as shown in FIG. 6. In various embodiments, vanes 530 also extend from the ends of the plates 120 at the intake chamber outlets 340 and the exit chamber inlets 420 that communicate with the combustion chamber 130.

Figure 7:
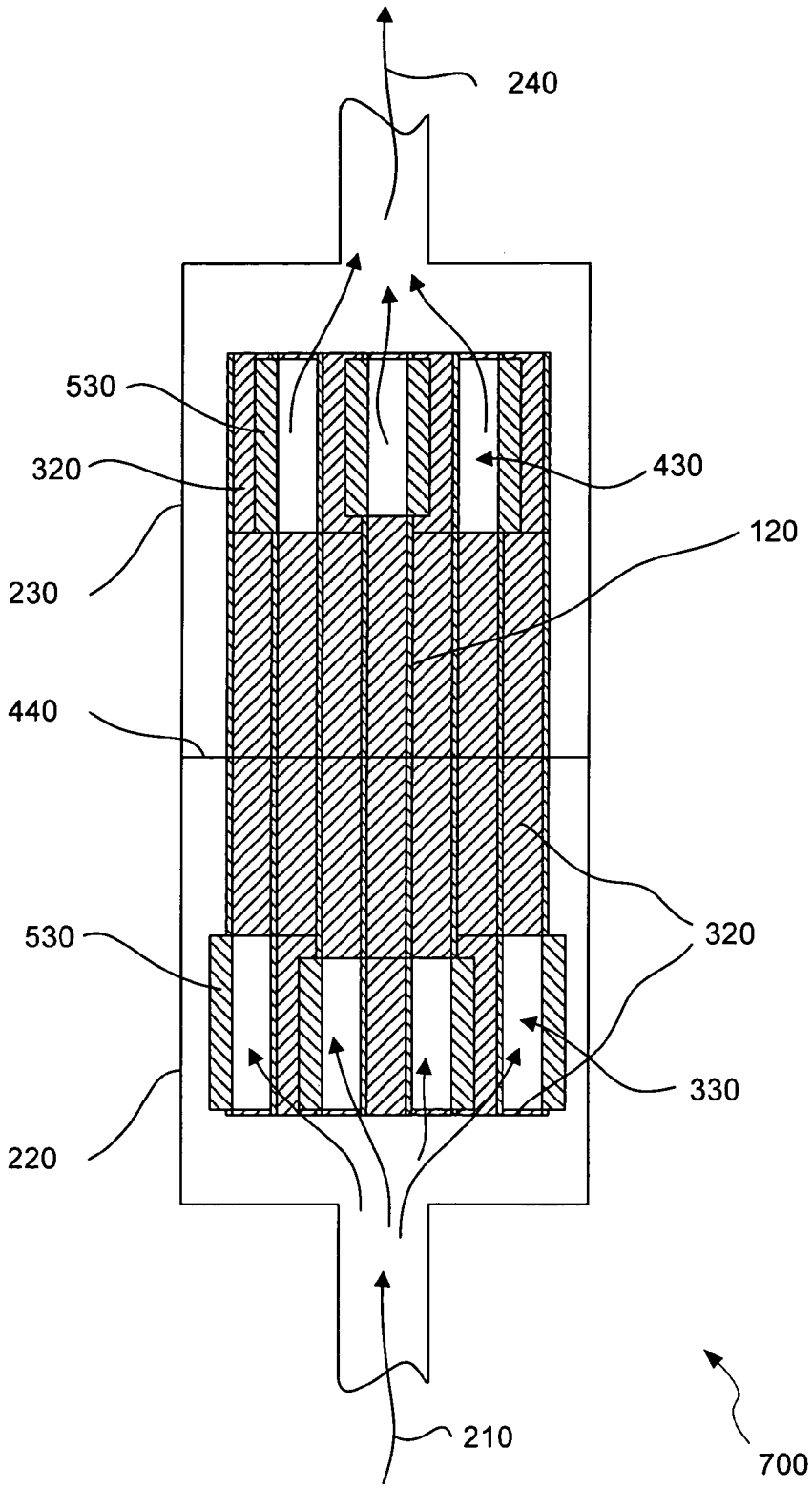
FIG. 7 depicts a cross section taken along the line 7-7 of FIG. 1.

FIG. 7 shows a cross section 700 taken along the section 7-7 of exhaust system 100 of FIG. 1. Cross section 700 shows an end-on view of multiple plates 120, including the vanes 530, and multiple spacers 320 forming alternating intake chambers inlets 330 and exit chambers outlets 430. Also depicted in FIG. 7 is the baffle 440 configured to prevent fluid communication between manifolds 220 and 230.

Figure 8:
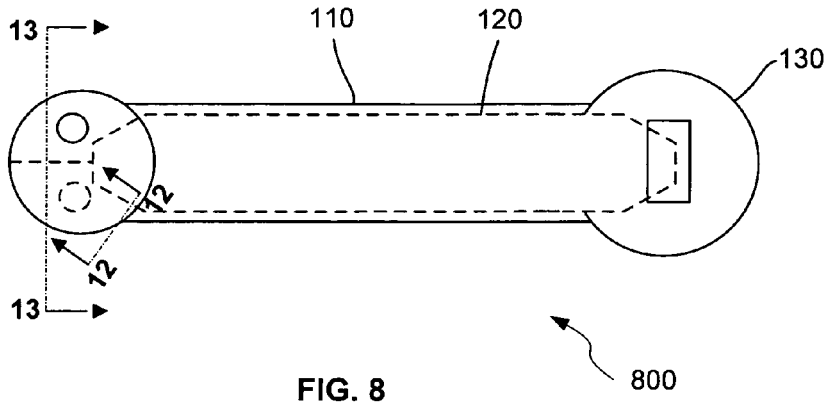
FIGS. 8 and 9 depict top and front views, respectively, of an exemplary system for burning particles in an exhaust system in accordance with another embodiment of the invention.
Figure 9:
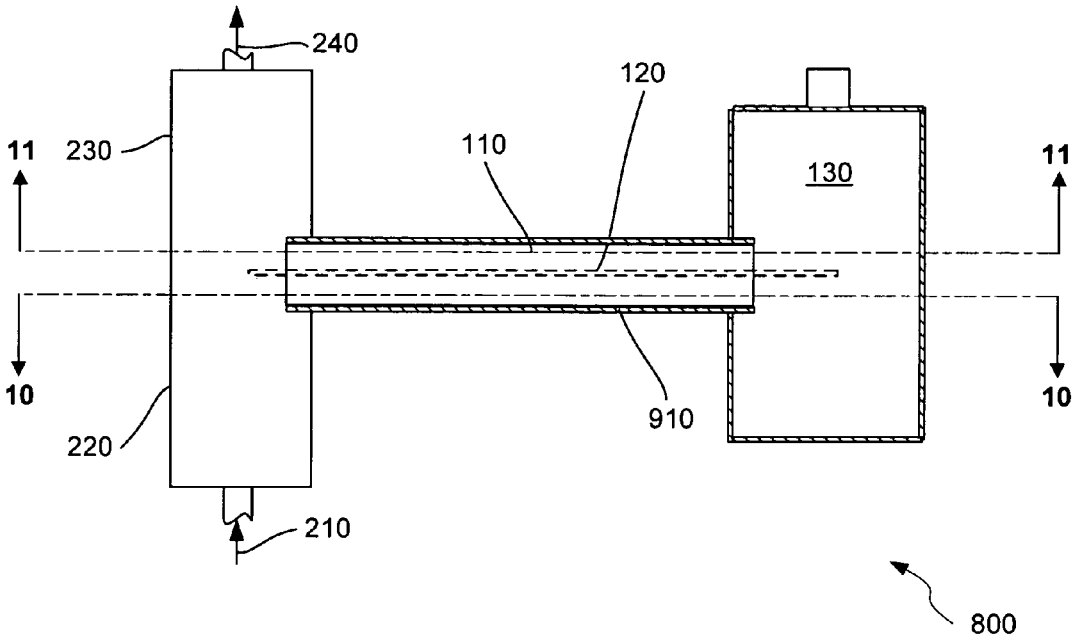

FIGS. 8 and 9 show top and front views, respectively, of another exemplary exhaust system 800. The exhaust system 800 is generally similar to the exhaust system 100 but differs with respect to the orientation of the heat exchanger 110. Specifically, the heat exchanger is rotated relative to the manifolds 220, 230 and/or the combustion chamber 130 such that the transverse plane 530 of the heat exchanger 110 is aligned vertically rather than horizontally. Accordingly, the baffle 440 is also rotated from horizontal to vertical.

Some embodiments of the exhaust system 100, 800 include insulation 910 around the heat exchanger 110 and the combustion chamber 130, as shown in FIG. 9. The use of insulation reduces the amount of energy required to heat the exhaust gas within the combustion chamber 130. More generally, it will be appreciated that insulation 910 can be applied individually to any of the heat exchanger 110, the combustion chamber 130, and the manifold 220, or to any combination of these components.

Figure 10:
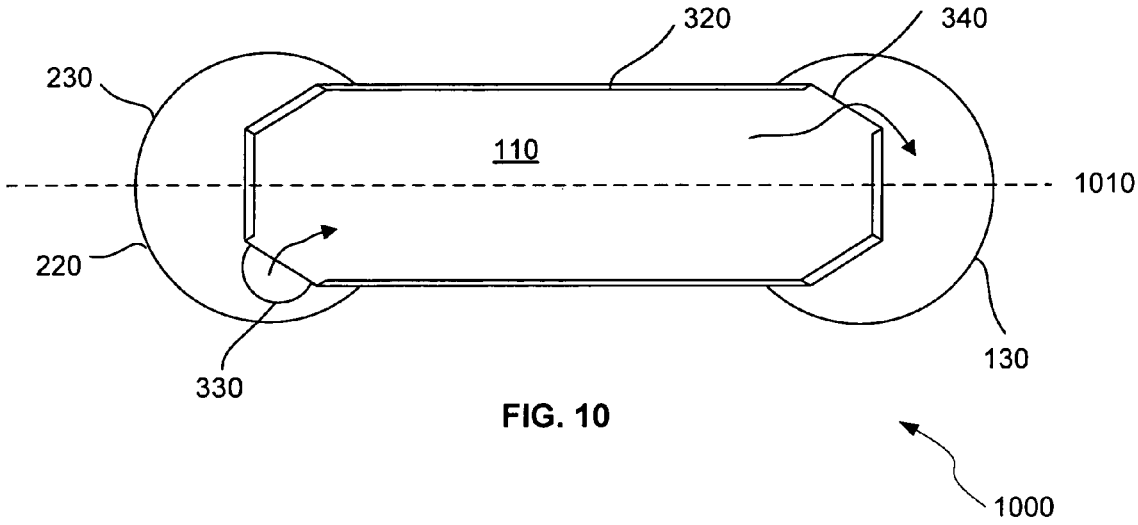
FIGS. 10 and 11 depict cross sections of the intake chamber and exit chamber, respectively, of the system shown in FIGS. 8 and 9.
Figure 11:
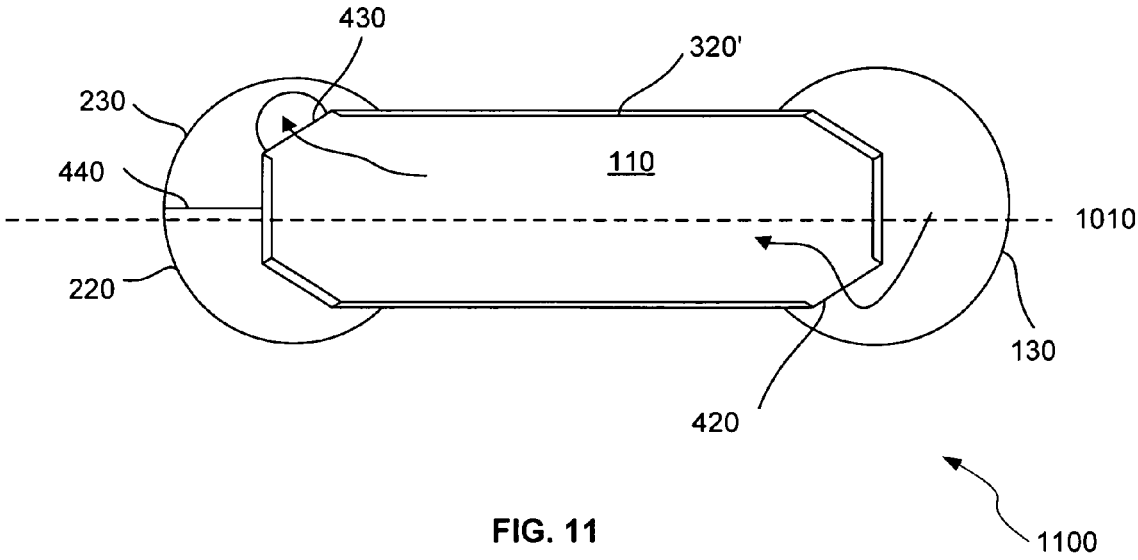

FIGS. 10 and 11 are cross sections of exhaust system 800. In FIG. 10, a cross section 1000 is taken along section 10-10 in FIG. 9 through an intake chamber 310, and in FIG. 11 a cross section 1100 is taken along the line 11-11 in FIG. 9 through an exit chamber 410. As before, the intake chamber 310 and the exit chamber 410 are formed between the plate 120, an exterior wall of the heat exchanger 110, and spacers 320. Openings between the spacers 320 form the inlets 330, 420 and outlets 340, 430. The intake chamber 310 is in fluid communication between the manifold 220 and the combustion chamber 130. The exit chamber 410 is in fluid communication between the combustion chamber 130 and the manifold 230. In various embodiments, manifolds 220 and 230 consist of a continuous tube separated by a vertical baffle 440.

The heat exchanger 110 is again characterized by a transverse plane 1010 with the inlet 330 below the transverse plane 1010 and the outlet 340 above the transverse plane 1010. Likewise, the inlet 420 is below the transverse plane 1010 and the outlet 430 is above the transverse plane 1010. The inlets 330, 420 and outlets 340, 430 are on opposite sides of the transverse plane 1010 so that fluid flows diagonally through the chambers 310, 410.

Figure 12:
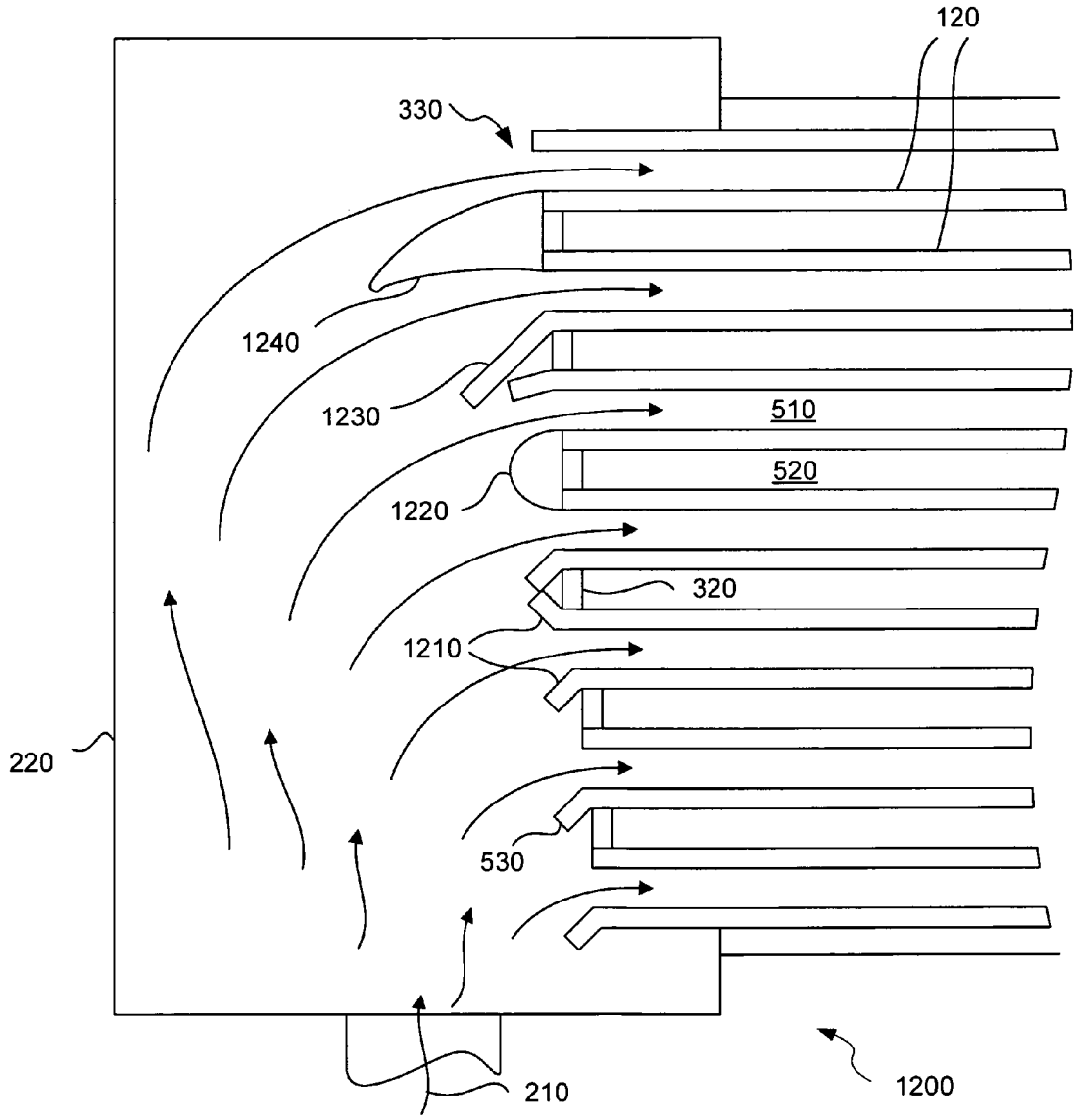
FIG. 12 depicts a cross section taken along the line 12-12 of FIG. 8 with several alternative implementations of a vane.

FIG. 12 shows a cross section 1200 taken along the section 12-12 within manifold 220 of exhaust system 800. Cross section 1200 shows multiple plates 120 forming alternating intake chambers 510 and exit chambers 520. As above, each chamber 510, 520 is formed between two plates 120 and spacers 320. FIG. 12 shows a number of alternative concepts for vanes 530 that can extend from the ends of the plates 120. In some embodiments, vanes 1210 are disposed on both sides of an opening. In other embodiments, vanes 1220 can be spherically shaped, vanes 1230 can be of different lengths, and vanes 1240 can be aerodynamically shaped. When vanes 530 on successive openings increasingly extend into a manifold, as in FIGS. 5 and 6, or as the succession of vanes 1220, 1230, and 1240, the vanes 530 are said to be "feathered." Feathering further helps to direct flow within the respective manifold to reduce flow friction loses.

Figure 13:
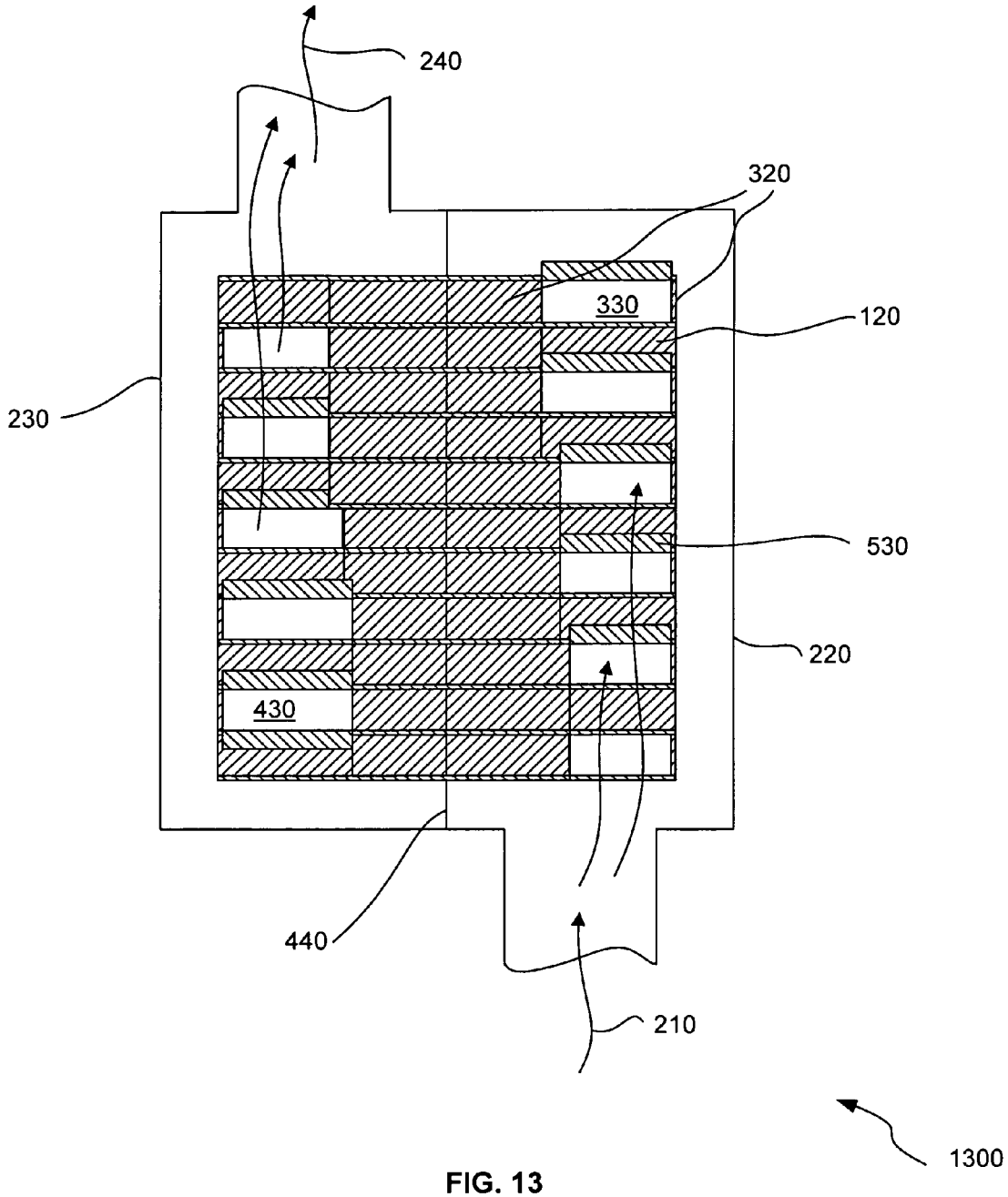
FIG. 13 depicts a cross section taken along the line 13-13 of FIG. 8.

FIG. 13 shows a cross section 1300 taken along section 13-13 of exhaust system 800. Cross section 1300 shows multiple plates 120, including vanes 530, and multiple spacers 320 forming alternating intake chambers inlets 330 and exit chambers outlets 430. Also depicted is baffle 440 configured to prevent fluid communication between manifolds 220 and 230. It will be appreciated that in these embodiments the manifolds 220 and 230 define separate but parallel longitudinal axes. These axes are approximately perpendicular to a plane defined by the plate 120 and parallel to the transverse plane 350.

Several further advantages of reverse flow heat exchangers 110 should be noted. For example, these heat exchangers are self-cleaning. It will be appreciated that should a deposit form on an internal surface of one of the plates 120, the restriction to the flow of exhaust gas around the deposit will tend to cause a local increase in the temperature at the restriction. Eventually, the local temperature increase will reach an ignition temperature of the deposit material, causing the deposit to burn away. Another advantage of the heat exchangers 110 is that the heated internal surfaces of the chambers 310, 410 reduce the resistance to fluid flow through the chambers 310, 410 thereby lowering head loss through the exhaust system 100. Further, it will be appreciated that the heat exchangers 110 can serve to muffle sound due to the expansions and contractions that the exhaust gas goes through as it passes through successive openings. The muffling effect can be further enhanced by tuning the dimensions of the chambers to behave as resonating chambers. Accordingly, heat exchangers 110 can replace mufflers on vehicles.

Figure 14:
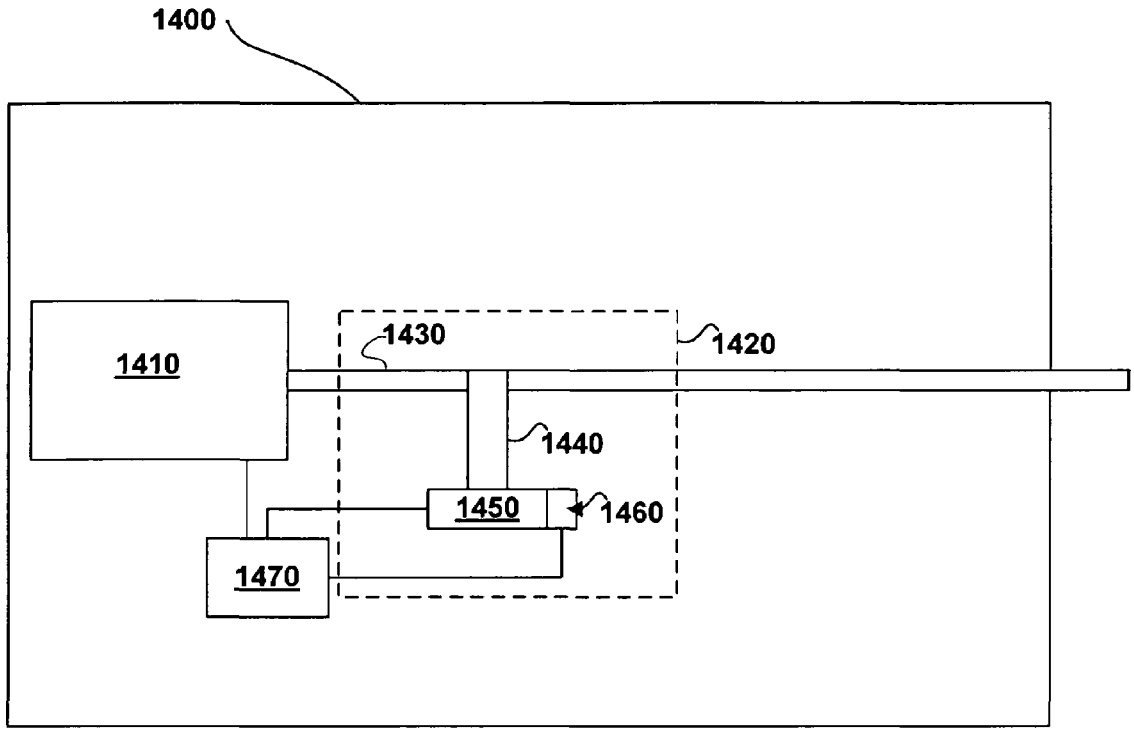
FIG. 14 depicts a schematic representation of a vehicle comprising an internal combustion engine and an exhaust system in accordance with another embodiment of the invention.

FIG. 14 shows a schematic representation of a vehicle 1400 comprising an internal combustion engine 1410, such as a diesel engine. The vehicle 1400 also comprises an exhaust system 1420 that includes an exhaust pipe 1430 from the engine 1410 to a reverse flow heat exchanger 1440, a combustion chamber 1450, and a radiation source 1460. The vehicle 1400 further comprises a controller 1470 for controlling the power to the radiation source. The controller 1470 can be coupled to the engine 1410 so that no power goes to the radiation source 1460 when the engine is not operating, for example. The controller 1470 can also control the radiation source 1460 in a manner that is responsive to engine 1410 operating conditions. Further, the controller 1470 can also control the radiation source 1460 according to conditions in the combustion chamber 1450. For instance, the controller 1470 can monitor a thermocouple in the combustion chamber 1450 so that no power goes to the radiation source 1460 when the temperature within the combustion chamber 1450 is sufficiently high to maintain a self-sustaining combustion reaction.

In the foregoing specification, the present invention is described with reference to specific embodiments thereof, but those skilled in the art will recognize that the present invention is not limited thereto. Various features and aspects of the above-described present invention may be used individually or jointly. Further, the present invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. An exhaust system comprising:

an engine configured to propel a vehicle and to produce exhaust gas;

a first exhaust manifold configured to receive exhaust gas from the engine;

a reverse flow heat exchanger coupled to the first exhaust manifold, the reverse flow heat exchanger including a plate defining a plane and separating an exit chamber and an intake chamber, the intake chamber having an intake chamber inlet and an intake chamber outlet located at opposing ends to allow flow therethrough, the exit chamber having an exit chamber inlet and an exit chamber outlet, the intake chamber inlet in fluid communication with the first exhaust manifold and configured to receive exhaust gas from the first exhaust manifold, the intake chamber outlet configured to communicate exhaust gas to the exit chamber inlet and;

a vane within the first exhaust manifold disposed relative to the intake chamber inlet so as to reduce resistance to fluid flow near the intake chamber inlet.

2. The exhaust system of claim 1 further comprising a second exhaust manifold coupled to the reverse flow heat exchanger and in fluid communication with the reverse flow heat exchanger through the exit chamber outlet.

3. The exhaust system of claim 2 wherein the first and the second exhaust manifolds are connected and separated by a baffle.

4. The exhaust system of claim 3 wherein the first and second exhaust manifolds share a common longitudinal axis that is approximately parallel to the plane of the plate.

5. The exhaust system of claim 3 wherein the first and second exhaust manifolds each define a longitudinal axis that is approximately perpendicular to the plane of the plate.

6. The exhaust system of claim 1 wherein the vane extends from an end of the plate.

7. The exhaust system of claim 1 wherein the vane includes a rounded end.

8. The exhaust system of claim 1 further comprising a heating manifold configured to receive exhaust gas from the intake chamber outlet and provide heated exhaust gas to the exit chamber inlet.

9. The exhaust system of claim 8 further comprising a radiation source configured to produce radiation within the heating manifold.

10. The exhaust system of claim 1 wherein the reverse flow heat exchanger further includes a thermal insulation layer.

11. The exhaust system of claim 1 further comprising a plurality of plates each including a vane extending therefrom, wherein the vanes are feathered.

12. A vehicle exhaust system comprising:

an exhaust manifold configured to receive exhaust gas from an internal combustion engine; and a reverse flow heat exchanger coupled to the exhaust manifold, the reverse flow heat exchanger including a transverse plane, and a plurality of parallel plates separating a number of chambers, the chambers comprising a set of intake chambers alternating with a set of exit chambers, each intake chamber having an inlet and an outlet and each exit chamber having an inlet and an outlet, the inlets of the intake chambers being in fluid communication with the exhaust manifold and configured to receive exhaust gas from the exhaust manifold and the outlets of the intake chambers being in fluid communication with the inlets of the exit chambers and configured to communicate exhaust gas to the inlets of the exit chambers.

13. The exhaust system of claim 12 wherein the inlets of the intake chambers are disposed below the transverse plane.

14. The exhaust system of claim 13 wherein the outlets of the intake chambers are disposed above the transverse plane.

15. The exhaust system of claim 14 wherein the inlets of the exit chambers are disposed below the transverse plane.

16. The exhaust system of claim 15 wherein the outlets of the exit chambers are disposed above the transverse plane.

17. The exhaust system of claim 12 further comprising a heating manifold coupled to the reverse flow heat exchanger, wherein the outlets of the intake chambers are in fluid communication with the inlets of the exit chamber and configured to communicate exhaust gas to the inlets of the exit chambers through the heating manifold.

18. The exhaust system of claim 17 further comprising a radiation source configured to heat exhaust gas within the heating manifold.

19. The exhaust system of claim 12 further comprising an exit manifold coupled to the reverse flow heat exchanger and in fluid communication with the reverse flow heat exchanger through the exit chamber outlet.

20. A vehicle comprising:

an internal combustion engine; and an exhaust system configured to receive exhaust gas from the internal combustion engine and to remove particles from exhaust gas, the exhaust system including an exhaust manifold and a reverse flow heat exchanger coupled to the exhaust manifold and including a plurality of parallel plates separating a number of chambers, the chambers comprising a set of intake chambers alternating with a set of exit chambers, each intake chamber having an inlet and an outlet, each exit chamber having an inlet and an outlet, the inlets of the intake chambers being in fluid communication with the exhaust manifold and configured to receive exhaust gas from the exhaust manifold and the outlets of the intake chambers being in fluid communication with the inlets of the exit chambers and configured to communicate exhaust gas to the inlets of the exit chambers.

21. The vehicle of claim 20 further comprising a plurality of vanes extending from the plates into the exhaust manifold.

22. The vehicle of claim 21 wherein the vanes are feathered.

23. The vehicle of claim 20 further comprising a combustion chamber coupled to the reverse flow heat exchanger, wherein the outlets of the intake chambers communicate exhaust gas to the inlets of the exit chambers through the combustion chamber.

24. The vehicle of claim 20 wherein the reverse flow heat exchanger further includes a thermal insulation layer.

25. The vehicle of claim 20 wherein the chambers are configured to act as resonating chambers.

26. The vehicle of claim 20 further comprising a heating manifold providing fluid communication of exhaust gas between the outlets of the intake chambers and the inlets of the exit chambers.

27. The vehicle of claim 26 wherein the heating manifold is a combustion chamber including a radiation source.

* * * * *